US006024603A

United States Patent [19]

Chen et al.

[11] Patent Number: 6,024,603

[45] Date of Patent: Feb. 15, 2000

[54] BOARD LOCK

[75] Inventors: Spencer Chen, Buena Park, Calif.; Thomas R. L. Tsai, Tu-Chen, Taiwan

[73] Assignee: Hon Hai Precision Ind. Co., Ltd., Taipei Hsien, Taiwan

[21] Appl. No.: 09/339,065

[22] Filed: Jun. 23, 1999

[30] Foreign Application Priority Data

Nov. 3, 1998 [TW] Taiwan ..... 87218243

[51] Int. Cl.[7] ..... H01R 13/73

[52] U.S. Cl. ..... 439/571

[58] Field of Search ..... 439/567, 571, 439/572, 573

[56] References Cited

U.S. PATENT DOCUMENTS

| | | | |
|---|---|---|---|
| 4,202,593 | 5/1980 | Abernethy et al. | 439/571 |
| 5,108,308 | 4/1992 | Northcraft et al. | 439/571 |
| 5,137,454 | 8/1992 | Baechtle | 439/571 |
| 5,281,166 | 1/1994 | Yu et al. | 439/571 |
| 5,316,500 | 5/1994 | Vanaleck et al. | 439/567 |

*Primary Examiner*—Gary F. Paumen
*Attorney, Agent, or Firm*—Wei Te Chung

[57] ABSTRACT

A board lock includes an outer member defining a central hole for receiving an inner member therein. The outer member has a plurality of resilient legs which are expanded by insertion of the inner member. The outer member is received in holes defined in an electrical connector and a printed circuit board. The expansion of the legs causes the legs to engage with an inner surface of the hole of the printed circuit board thereby securing the connector to the printed circuit board. The legs of the outer member are provided with threading which provides an effective and secure engagement between the legs and the hole. Securing the board lock to the circuit board by means of the engagement between the outer member and the inner surface of the hole, together with the resiliency of the legs, allows the board lock to be fixed to holes of different sizes and depths.

9 Claims, 6 Drawing Sheets

BOARD LOCK

BACKGROUND OF THE INVENTION

1. Field of the Invention

The present invention generally relates to a board lock for securing an electrical to a substrate, and in particular to a universal board lock which is capable of securing an electrical connector to substrates of different thicknesses.

2. The Prior Art

An electrical circuit usually comprises a printed circuit board on which a plurality of electrical elements and devices are mounted. Some of the electrical elements are fixed to the circuit board by means of external fasteners or board locks before they are soldered to the circuit board. Examples of board locks are shown in Taiwan Patent Application Nos. 84101384, 83112290, 85207102, and 86201142.

FIG. 5 of the attached drawings shows a conventional board lock 5. The board lock 5 comprises an expanded end 51 from which a pair of resilient legs 52 extend in an axial direction. Each of the resilient legs 52 has a barb 521 formed on a free end thereof.

The board lock 5 is received in a bore 61 defined in an electrical device 6 and supported in the bore 61 with the legs 52 extending through a narrow section of the bore 61. The legs 52 are received in a hole 21 defined in a circuit board 2. The free ends of the legs 52 extend through the hole 21 and the barbs 521 engage with a bottom face of the circuit board thereby securing the electrical device 6 to the circuit board 2.

The securing of the electrical device 6 to the circuit board 2 is basically provided by the engagement between the barbs 521 and the bottom face of the circuit board 2. This implies that the axial dimension of the legs 52 has to substantially correspond to the thickness of the circuit board 2 in order to ensure that the electrical device 6 is effectively secured to the circuit board 2. A disadvantage associated with this is that different board locks must be used with circuit boards of different thicknesses.

It is thus desirable to have a universal board lock that allows an electrical device to be effectively secured to substrates of different thicknesses.

SUMMARY OF THE INVENTION

Accordingly, an object of the present invention is to provide a board lock which is capable of mounting an electrical device to circuit boards of different thicknesses.

Another object of the present invention is to provide a board lock comprising a plurality of legs having a threaded external surface which engages with an inner surface of a hole defined in a circuit board for securing an electrical device to the circuit board.

A further object of the present invention is to provide an electrical connection device which comprises an electrical connector secured to a circuit board by means of the board lock described above.

To achieve the above objects, a board lock in accordance with the present invention comprises an outer member defining a central hole for receiving an inner member therein. The outer member has a plurality of resilient legs which are expandable by insertion of the inner member. The outer member is received in holes defined in an electrical connector and a printed circuit board. The expansion of the legs causes the legs to engage with an inner surface of the hole of the printed circuit board thereby securing the connector to the printed circuit board. The legs of the outer member are provided with threading which provides an effective and secure engagement between the legs and the hole. Securing the board lock to the circuit board by means of the engagement between the outer member and the inner surface of the hole, together with the resiliency of the legs, allows the board lock to be fixed to holes of different sizes and depths.

BRIEF DESCRIPTION OF THE DRAWINGS

The present invention will be apparent to those skilled in the art by reading the following description of a preferred embodiment thereof, with reference to the accompanying drawings, in which.

DETAILED DESCRIPTION OF THE PREFERRED EMBODIMENT

Figure 1:
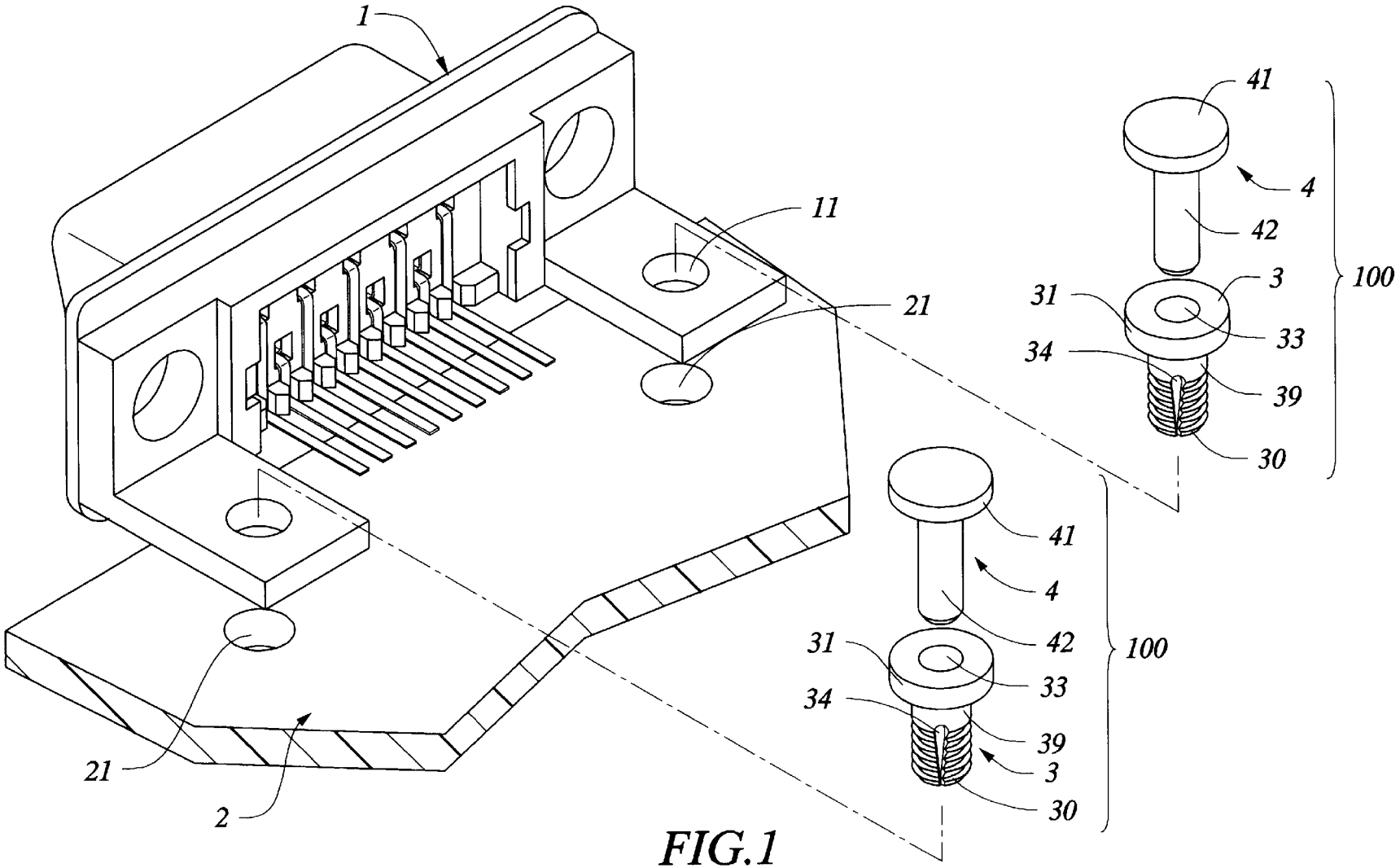
FIG. 1 is a perspective view of two board locks constructed in accordance with the present invention for securing an electrical connector to a circuit board.

Referring to the drawings and in particular to FIG. 1, a board lock 100 constructed in accordance with the present invention for securing an electrical connector 1 to a circuit board 2 comprises an outer member 3 and an inner member 4. The outer member 3 defines a central bore 33 into which the inner member 4 is insertable.

Figure 2A:
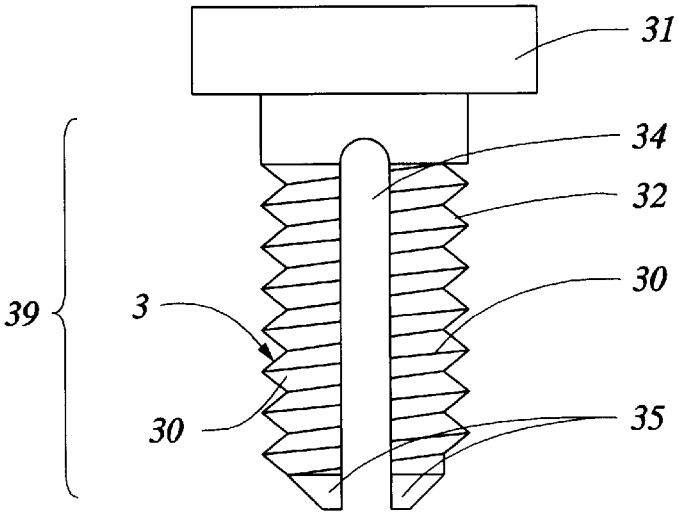
FIG. 2A is a side elevational view of an outer member of the board lock in accordance with the present invention.
Figure 2B:
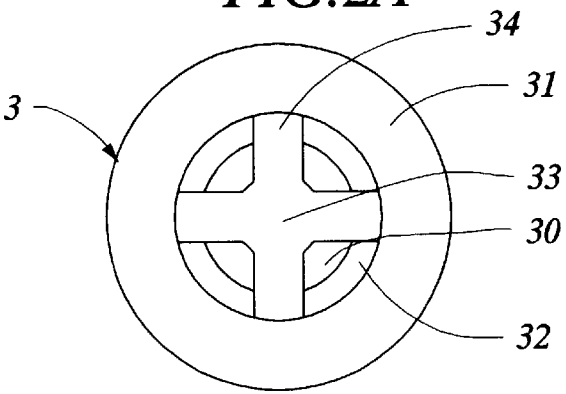
FIG. 2B is a bottom view of the outer member of the board lock of the prevent invention.

As shown in FIGS. 2A and 2B, the outer member 3 comprises an expanded end 31 from which an elongate body 39 extends in an axial direction. The central bore 33 is defined through both the body 39 and expanded end 31 of the outer member 3. The body 39 of the outer member 3 is provided with sharpened projections, such as an external threading 32. The body 39 of the outer member 3 is provided with at least one axially defined slit 34 which is coincident with the central bore 33. The slit 34 is defined through the body 39 as shown in FIG. 2B. FIG. 2B also reveals that two slits 34 are defined in the body 39 of the outer member 3 and intersect each other thereby defining a cross that is substantially coincident with the central bore 33. Thus, the elongate body 39 of the outer member 3 is divided into four legs 30.

The outer member 3 is made of a material that renders the legs 30 resilient and thus deflectable. The legs 30 are arranged to have free ends 35 thereof converging toward each other by reducing the slits 34 from a first width proximate the expanded end 31 toward a smaller, second width at the free ends 35. This is the non-expanded condition of the outer member 3 as shown in FIG. 3A, wherein the elongate body 39 of the outer member 3 is tapered near the free ends 35.

The inner member 4, as shown in FIG. 1, comprises an elongate body 42 extending from an expanded end 41. The body 42 is receivable in the central bore 33 of the outer member 3. The body 42 has a cross-sectional size that is at least greater than the second width of the slits 34 whereby by forcing the body 42 of the inner member 4 toward the free ends 35 of the legs 30, the legs 30 move away from each other to an expanded condition as shown in FIG. 2A.

The expanded end 41 of the inner member 4 is supported on the expanded end 31 of the outer member 3.

Figure 3A:
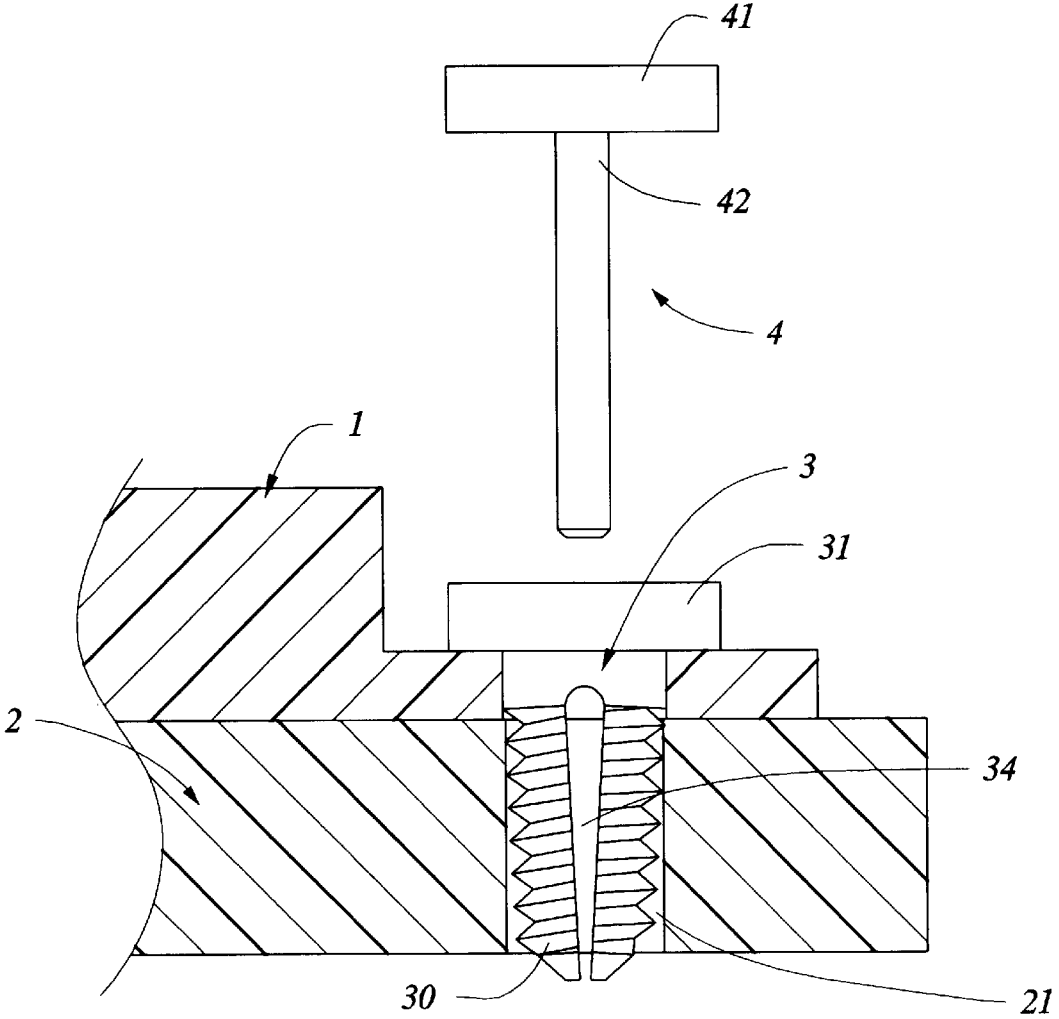
FIG. 3A is a cross-sectional view showing the condition when the electrical connector is mounted to the circuit board by means of the board lock of the present invention and the inner member is not yet received in the outer member yet.
Figure 3B:
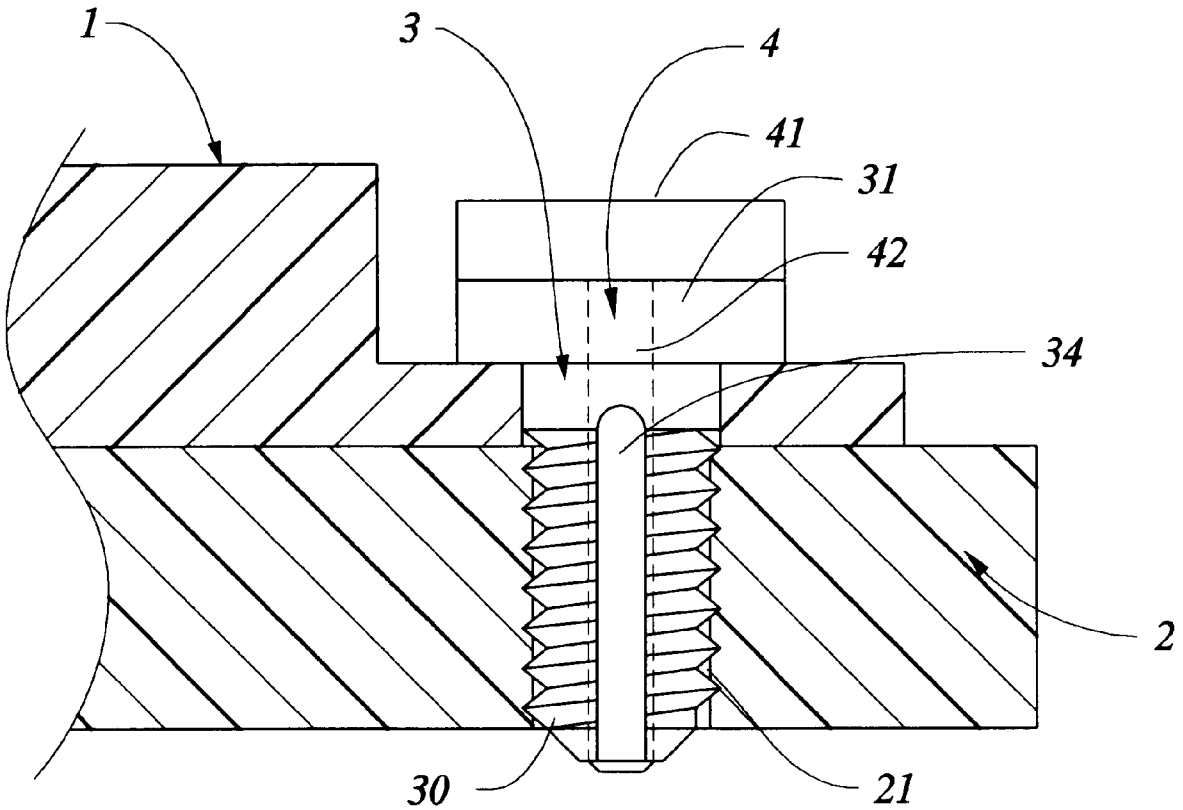
FIG. 3B is a cross-sectional view showing the condition when the electrical connector is mounted to the circuit board by means of the board lock of the present invention and the inner member is received in the outer member.

As shown in FIG. 3A, the tapered, non-expanded configuration of the outer member 3 allows the body 39 thereof to be readily inserted through a hole 11 defined in the connector 1 and into a corresponding hole 21 defined in the circuit board 2 with the expanded end 31 supported on the connector 1 wherein said body 39 may be snugly received within the hole 11. By inserting the body 42 of the inner member 4 into the central bore 33 of the outer member 3, the legs 30 of the outer member 3 move from the non-expanded condition to the expanded condition whereby the threading 32 of the outer member 3 engages an inner surface of the hole 21 of the circuit board 2, as shown in FIG. 3B. The engagement between the threading 32 and the inner surface of the hole 21 secures the outer member 3 to the circuit board 2.

Figure 4:
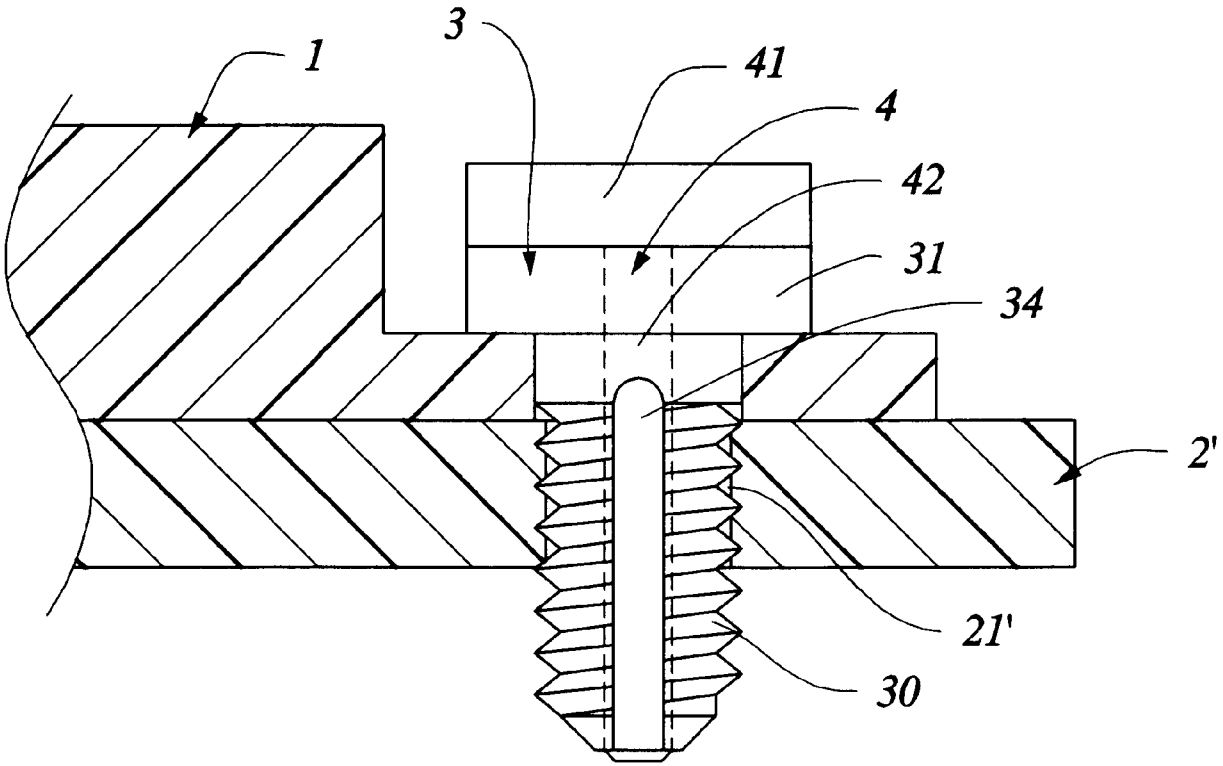
FIG. 4 is a view similar to FIG. 3B, but showing the board lock mounting the electrical connector to a thinner circuit board.
Figure 5:
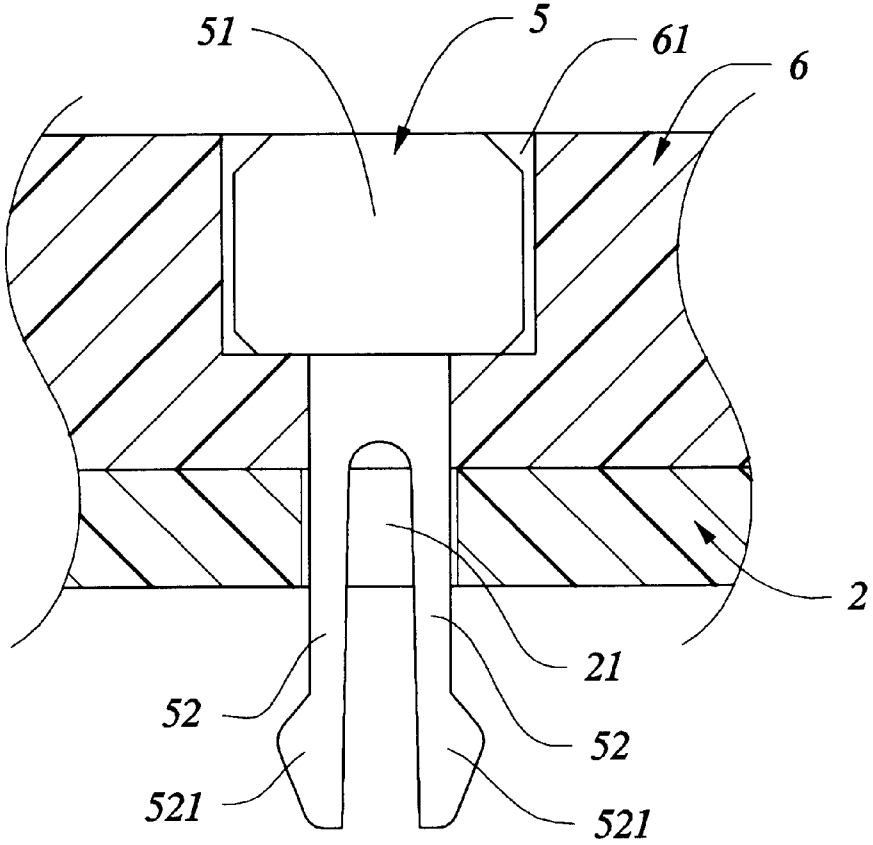
FIG.5 (PRIOR ART)
FIG. 5 is a cross-sectional view of a prior art board lock securing an electrical device to a substrate.

By engaging with an inner face of a hole, rather than engaging with a bottom face of the circuit board, the board lock 100 of the present invention is also capable of securing the connector 1 to a circuit board 2' of a different thickness as shown in FIG. 4. The circuit board 2' which has a smaller thickness defines a hole 21' in which the body 39 of the outer member 3 is received, but with a substantial portion thereof extending beyond a bottom face of the circuit board 2'.

Of course, for a circuit board having a greater thickness, the present invention is also applicable.

Furthermore, if desired, the inner member 4 may only be partially inserted into the outer member 3. This causes only a reduced expansion of the free ends 35 of the legs 30 of the outer member 3 and thus allows the board lock 100 to be used with a circuit board having holes of reduced diameter.

Although the present invention has been described with reference to a preferred embodiment, it is apparent to those skilled in the art that a variety of modifications and changes may be made without departing from the scope of the present invention which is intended to be defined by the appended claims.

What is claimed is:

1. A board lock comprising:

an outer member comprising an elongate body extending in an axial direction, the body having sharpened projections formed on an external surface thereof and a central hole defined therethrough in the axial direction, at least two slits being axially defined through the body coinciding with the central bore thereby defining a plurality of resilient legs having free ends, each slit being reduced from a first width at an end of the body opposite the free ends to a smaller, second width at the free ends, the resilient legs being expandable whereby the free ends thereof are movable away from each other from a first distance corresponding to the second width of the slits to a second distance greater than the second width of the slits; and an inner member comprising an elongate body extending in the axial direction, the body having a cross-sectional dimension slightly greater than the first width of the slits and not smaller than the second width of the slits, wherein the body of the inner member is forcibly insertable into the central bore of the outer member to cause expansion of the outer member and thus drive the free ends of the legs apart from the first distance to the second distance;

wherein the outer member is adapted to be received into aligned holes defined in two separate members and expanded by the inner member to secure the two separate members together by means of engagement of the external sharpened projection of the outer member with an inside surface of the hole of at least one of the two separate members.

2. The board lock as claimed in claim 1, wherein the outer member comprises a first expanded end opposite the free ends of the legs which is adapted to be supported on one of the two separate members.

3. The board lock as claimed in claim 2, wherein the inner member comprises a second expanded end positionable on the first expanded end of the outer member.

4. The board lock as claimed in claim 1, wherein the sharpened projections comprise external threading.

5. An electrical connection device comprising:

a connector adapted to be mounted to a printed circuit board, the connector having at least one first hole defined therein, the first hole being in alignment with a second hole defined in the printed circuit board; and a fastener comprising:

an outer member comprising an elongate body extending in an axial direction and received in the holes of the connector and the printed circuit board, the body tapering from a first end toward a second end and having sharpened projections formed on an external surface thereof, at least two slits being axially defined through the body thereby forming a plurality of resilient legs having free ends, the legs being deflectable whereby the free ends thereof are movable away from each other from an original position to an expanded position; and an inner member comprising an elongate body insertable into the outer member to deflect the legs, thereby moving the free ends of the legs to the expanded position and thus causing the sharpened projections to engage with an inner surface of the holes.

6. The electrical connection device as claimed in claim 5, wherein the sharpened projections comprise an external threading.

7. The electrical connection device as claimed in claim 5, wherein the outer member comprises a first expanded end adapted to be supported on the connector.

8. The electrical connection device as claimed in claim 7, wherein the inner member comprises a second expanded end positionable on the first expanded end of the outer member.

9. An electrical connector assembly comprising:

a connector defining a first hole;

a board lock including:

an outer member with a hollow elongate body extending in an axial direction, of which an upper portion is dimensioned to be radially larger than the first hole, a middle portion is dimensioned to be snugly received within the first hole, and an expandable lower portion is configured to be tapered in a convergent manner with outer threads thereon;

an inner member comprising an elongate body with an expanded head on the top; and a substrate defining therein a second hole, said second hole dimensioned to be radially larger than the tapered lower portion of the outer member; whereby when the inner member is inserted into the outer member, the expanded head of the inner member abuts against the upper portion of the outer member, and the lower portion of the outer member is outwardly expanded from a tapered state to a straight state to have the outer threads thereof engage an inner surface of the second hole of the substrate.

* * * * *